US012090375B2

(12) United States Patent
Rife

(10) Patent No.: US 12,090,375 B2
(45) **Date of Patent: *Sep. 17, 2024**

(54) GOLF CLUB PUTTER

(71) Applicant: Guerin D. Rife, Carlsbad, CA (US)

(72) Inventor: Guerin D. Rife, Carlsbad, CA (US)

(73) Assignee: Evnroll Putters, LLC, Carlsbad, CA (US)

( * ) Notice: Subject to any disclaimer, the term of this patent is extended or adjusted under 35 U.S.C. 154(b) by 219 days.

This patent is subject to a terminal disclaimer.

(21) Appl. No.: 17/724,869

(22) Filed: Apr. 20, 2022

(65) Prior Publication Data

US 2022/0241656 A1 Aug. 4, 2022

Related U.S. Application Data

(63) Continuation of application No. 15/410,619, filed on Jan. 19, 2017, now Pat. No. 11,420,099.

(51) Int. Cl.
*A63B 53/04* (2015.01)

(52) U.S. Cl.
CPC ..... *A63B 53/0487* (2013.01); *A63B 53/0445* (2020.08)

(58) Field of Classification Search
CPC ..... A63B 53/0487; A63B 53/0445
USPC ..... 473/331
See application file for complete search history.

(56) References Cited

U.S. PATENT DOCUMENTS 1,289,553 A * 12/1918 Sanders ..... A63B 53/047 473/331
1,337,958 A * 4/1920 Reach ..... A63B 60/00 473/331
1,536,616 A * 5/1925 Manning ..... A63B 53/0466 473/331
1,965,954 A * 7/1934 Henry ..... A63B 60/00 473/331
2,005,401 A * 6/1935 Storz ..... A63B 53/047 473/331
D122,795 S * 10/1940 Geerlings ..... 473/331
D148,193 S * 12/1947 Smith ..... D21/750
3,869,126 A * 3/1975 Thompson ..... A63B 53/04 473/331
4,413,825 A * 11/1983 Sasse ..... A63B 53/04 473/331
4,468,034 A * 8/1984 Duclos ..... A63B 69/3632 33/508
4,508,349 A * 4/1985 Gebauer ..... A63B 53/04 473/330

(Continued)

*Primary Examiner* — Sebastiano Passaniti
(74) *Attorney, Agent, or Firm* — DICKINSON WRIGHT PLLC

(57) ABSTRACT

A putter type golf club head having a frontal ball striking face that engages and grips a golf ball during the execution of a putting stroke to direct the golf ball in a straight line toward the intended target. The face includes a plurality of ball striking land areas and a plurality of adjacent and complimentary recessed channels that form an opening toward and on either side of the midpoint of the hitting area of the face. The ball contact areas are smaller than the adjacent recessed channels at the midpoint of the hitting area of the face. Gripping edges at the interface of the land areas and the recessed channels redirect the golf ball toward the intended target when the ball is miss hit away from the midpoint of the face.

12 Claims, 3 Drawing Sheets

(56) References Cited

U.S. PATENT DOCUMENTS 4,690,407 A * 9/1987 Reisner ..... A63B 60/16 473/297
4,964,641 A * 10/1990 Miesch ..... A63B 53/0487 473/331
5,171,017 A * 12/1992 Betancourt ..... A63B 69/3667 473/218
5,203,453 A * 4/1993 Dirito ..... A63B 69/3667 33/759
5,224,497 A * 7/1993 Ehlers ..... A61B 17/12009 606/140
5,244,209 A * 9/1993 Benzel ..... A63B 60/24 473/297
5,299,807 A * 4/1994 Hutin ..... A63B 53/04 473/329
5,354,059 A * 10/1994 Stuff ..... A63B 60/00 473/331
5,397,127 A * 3/1995 Kawada ..... A63B 53/0466 473/331
5,618,239 A * 4/1997 Rife ..... A63B 53/0487 473/331
5,637,044 A * 6/1997 Swash ..... A63B 53/0487 473/331
5,688,186 A * 11/1997 Michaels ..... A63B 53/047 473/331
5,688,190 A * 11/1997 Rowland ..... A63B 60/00 473/331
5,709,616 A * 1/1998 Rife ..... A63B 53/0487 473/331
5,779,560 A * 7/1998 Buck ..... C22C 47/068 473/329
5,785,610 A * 7/1998 Birmingham ..... A63B 53/04 473/331
D398,357 S * 9/1998 De La Cruz ..... D21/750
5,967,903 A * 10/1999 Cheng ..... A63B 53/047 473/349
5,984,801 A * 11/1999 Mason ..... A63B 69/3667 473/270
6,110,057 A * 8/2000 McKinnon ..... A63B 53/007 473/331
6,183,379 B1 * 2/2001 Kim ..... A63B 53/0487 473/331
6,193,614 B1 * 2/2001 Sasamoto ..... A63B 60/00 473/345
6,224,497 B1 * 5/2001 Antonious ..... A63B 53/047 473/331
6,257,994 B1 * 7/2001 Antonious ..... A63B 53/0487 473/331
6,368,231 B1 * 4/2002 Chen ..... A63B 53/047 473/330
6,419,593 B1 * 7/2002 Heinrich ..... C23C 4/129 473/409
6,511,386 B1 * 1/2003 Cacicedo ..... A63B 60/10 473/549
6,758,759 B2 * 7/2004 Gobush ..... A63B 69/3658 473/131
6,779,277 B2 * 8/2004 Sones ..... A63B 53/007 473/409
6,799,377 B2 * 10/2004 Sones ..... A63B 60/42 33/508
6,849,004 B2 * 2/2005 Lindsay ..... A63B 53/0487 473/331
7,056,226 B2 * 6/2006 Kennedy ..... A63B 53/04 473/330
7,285,057 B2 * 10/2007 Mann, Jr. ..... A63B 53/047 473/331
7,621,828 B2 * 11/2009 Voges ..... A63B 69/3632 473/409
7,635,310 B2 * 12/2009 Keough ..... A63B 60/24 473/297
8,066,586 B2 * 11/2011 Solheim ..... A63B 53/04 473/331
8,282,505 B2 * 10/2012 Solheim ..... A63B 60/00 473/331
8,337,324 B2 * 12/2012 Sander ..... A63B 53/047 473/331
8,366,566 B1 * 2/2013 Rollinson ..... A63B 60/54 473/332
8,523,703 B2 * 9/2013 Rife ..... A63B 53/0487 473/331
8,764,578 B2 * 7/2014 Solheim ..... A63B 53/047 473/331
8,790,193 B2 * 7/2014 Serrano ..... A63B 53/04 473/331
8,814,715 B2 * 8/2014 Franklin ..... A63B 53/04 473/331
8,986,132 B2 * 3/2015 Chen ..... A63B 53/0466 473/328
8,986,133 B2 * 3/2015 Bennett ..... A63B 60/00 473/344
9,108,088 B2 * 8/2015 Serrano ..... A63B 53/04
9,452,326 B2 * 9/2016 Serrano ..... A63B 53/0466
9,561,407 B2 * 2/2017 Serrano ..... A63B 53/047
9,849,351 B2 * 12/2017 Serrano ..... A63B 53/04
9,943,735 B2 * 4/2018 Rife ..... A63B 53/0487
11,420,099 B2 * 8/2022 Rife ..... A63B 53/0487
2003/0008731 A1 * 1/2003 Anderson ..... A63B 60/42 473/407
2003/0157995 A1 * 8/2003 Mahaffey ..... A63B 53/0466 473/345
2004/0030527 A1 * 2/2004 Rankin ..... G06T 7/20 702/153
2005/0020376 A1 * 1/2005 Huang ..... A63B 53/047 473/324
2005/0026717 A1 * 2/2005 Jones ..... A63B 53/0487 473/340
2005/0164806 A1 * 7/2005 Solheim ..... A63B 53/0487 473/342
2005/0181888 A1 * 8/2005 Hou ..... A63B 53/047 473/332
2006/0189414 A1 * 8/2006 Voges ..... A63B 71/0622 473/131
2006/0199661 A1 * 9/2006 Deng ..... A63B 60/02 473/340
2006/0211514 A1 * 9/2006 Deshmukh ..... A63B 53/0466 473/345
2007/0049403 A1 * 3/2007 Chen ..... A63B 60/00 473/347
2007/0072698 A1 * 3/2007 Juang ..... A63B 53/04 473/332
2007/0135229 A1 * 6/2007 Lo ..... A63B 53/0487 473/324
2008/0009363 A1 * 1/2008 Solodovnick ..... A63B 60/24 473/297
2008/0076597 A1 * 3/2008 Roach ..... C25D 5/022 473/330
2008/0096687 A1 * 4/2008 Chen ..... A63B 53/047 473/349
2008/0234066 A1 * 9/2008 Jones ..... A63B 53/0487 473/282
2009/0005191 A1 * 1/2009 Lin ..... A63B 53/0466 473/331
2009/0156328 A1 * 6/2009 Reese ..... A63B 53/0487 473/331
2010/0087269 A1 * 4/2010 Snyder ..... A63B 60/00 473/331
2011/0009211 A1 * 1/2011 Chao ..... A63B 60/00 473/347
2011/0039636 A1 * 2/2011 Cackett ..... A63B 60/52 473/345
2012/0196700 A1 * 8/2012 Rollinson ..... A63B 53/0487 473/340
2013/0047453 A1 * 2/2013 Rife ..... A63B 60/42 33/508
2013/0072321 A1 * 3/2013 Morales ..... B23K 20/233 228/159
2013/0324301 A1 * 12/2013 Boyd ..... A63B 60/00 473/342

(56) References Cited

U.S. PATENT DOCUMENTS

| | | | | |
|---|---|---|---|---|
| 2014/0274454 | A1* | 9/2014 | Snyder | A63B 53/047 473/332 |
| 2015/0045136 | A1* | 2/2015 | Boccieri | A63B 53/14 473/297 |
| 2015/0057100 | A1* | 2/2015 | Serrano | A63B 53/065 473/331 |
| 2015/0375069 | A1* | 12/2015 | Abbott | A63B 53/0487 473/330 |
| 2020/0360774 | A1* | 11/2020 | Willmott | A63B 53/0487 |

* cited by examiner 14
16
15
18
10
20
98
24
22
12
99

GOLF CLUB PUTTER

CROSS-REFERENCE TO RELATED APPLICATION

This application claims priority to U.S. patent application Ser. No. 15/410,619, filed Jan. 19, 2017, the disclosure of which is incorporated by reference herein in its entirety.

FIELD OF THE INVENTION

The present invention relates to golf clubs and in particular to a configuration of the striking face of a putter.

BACKGROUND OF THE INVENTION

The game of golf is played with 14 clubs. One of those clubs, the putter, is responsible for approximately 40% of the total score of a round of golf. It is therefore very important to be accurate when using a putter to roll a golf ball toward and into the golf hole.

The putter is different from the rest of the other clubs in a set of golf clubs. All of the other clubs have varying degrees of loft in order to strike a golf ball with enough velocity to create a desired degree of upward launch and distance to propel a golf ball toward a target such as a fairway or putting green area that contains a hole. Once on the green the golfer must then roll the ball to the hole as accurately as possible. To do this it requires a club that has only 1 to four degrees of loft so that when struck typically with a putter head speed of 4 miles per hour or less, the ball will roll toward the hole with the intent to fall in and complete the hole. Putting requires a great degree of accuracy. It also creates the highest level of tension to the golfer. The reduction of this tension is a goal of every golfer.

How a ball hit by a putter starts rolling determines how and where the ball finishes. The ultimate purpose behind putter design is to design and create a putter that reduces the number of putts a golfer makes in a round of golf either through greater stability, better alignment features, better weighting for more stability or a face technology that increases accuracy in how it effects the ball at impact. The ultimate goal therefore is accuracy and having the fewest putts in a round of golf.

With typical conventional putters, the major factor with putts rolling off the intended target line is that the golf ball is hit on a small area on the putter face at the center of percussion that is located directly in front of the center of mass (CM). A golf ball struck directly in front of the CM will travel straight and true toward the intended target fine to the hole. However, it is very common to make contact with a ball to either side of the center of percussion and therefore not directly in front of the CM. When a golf ball is struck outside of the CM it will travel away from the intended target line. For example, a twenty foot putt hit ½" away from the CM toward the toe or heel of the putter will roll on average 6" outward and approximately one foot short of the intended target line to the hole. This dispersion away from the target line and resulting decrease in the distance the ball rolls is referred to as a "miss hit".

Since golfers miss hit putts about 95% of the time, the present invention was developed to create a way to reduce the effect of the off-center hits or miss hits so that the golf ball rolls consistently straight and true on the intended target line.

The most common putter head structure for reducing miss hits to gain more accuracy is made with a high moment of inertia (MOI). These putter heads are more stable and therefore more forgiving on miss hits. This is accomplished by locating weight outward away from the center of percussion on the putter face. The outward weight design increases the putter head's MOI and creates greater resistance to torque. As the MOI value increases, a larger the area on the putter face is created where a ball can be struck to minimize dispersion and improve accuracy. While these putter head designs help golfers to be more accurate, they tend to be very large and often, with cumbersome shapes that may be unattractive to the eye of the golfer. Typical prior art of this type are the many designs of putters that have substantial rearward and heel and toe weighting features usually in the form of heel and toe masses located away from the striking face.

Other putters for reducing dispersion from off-center hits are provided with a concave face on a putter that increasingly directs a golf ball inwardly to compensate for the outward direction caused by hitting a ball toward the heel or toe from the CM.

Another putter design for directing a golf ball inwardly on off-center hits uses a face material that is the most flexible in the center of the striking face and is progressively less flexible away from the center.

Whereas the above described putters provide some improvement in the way a golf ball rolls, the resulting putts still usually miss the intended target thereby leaving room for improved performance.

SUMMARY OF THE INVENTION

The present invention relates to a golf putter having a contact surface on the striking face of the putter that incorporates a surface that is structured to progressively direct a golf ball to roll in a straight direction when hit off-center and not angle away from the target line.

To illustrate this technology it is necessary to understand that a sideways V-shaped channel will direct a round object toward the direction of the opening of the V at impact. So for example if the opening of the V is aiming left, a ball will be directed to the left when making contact with the V shaped channel. This directional influence is greater if the contact surface is hard and less if the contact surface is soft.

Applying this technology, a golf putter of the present invention has a flat, relatively hard or rigid contact surface. The face of the putter is formed with land areas and directional recessed channels that expand inwardly from both the heel and toe toward the center of the putter face. This configuration forms the V-shaped channels, as described above, such that the widest areas of the recesses are proximate the center of the striking face. The recessed channels are stacked horizontally across the putter face in a heel to toe direction in close proximity, one over another, in order to create a progressively constant, inwardly directional effect on the round golf ball regardless where a ball is struck on the putter face. The interface of the land areas and recessed channels form a gripping edge that creates a directional gripping action against the golf ball when it is struck on the putter face. This gripping action by the gripping edges create a gearing effect that is progressively greater away from the center to match the sideways dispersion caused by off-center hits. By carefully designing the shapes of the land areas and recessed channels, the inward gearing effect can be matched to the outward dispersion caused by miss hits of the golf ball. This creates a face technology on a golf putter that virtually eliminates the effect of miss hits and directs every ball struck to travel on the intended target line to the golf hole. This increased accuracy will allow golfers to make more putts and shoot lower scores which is the primary goal in playing a round of golf.

A preferred embodiment of a golf putter of the present invention is created with precisely milled recessed channels in the face of a steel putter such that the recessed channels are formed between adjacent land areas in the form of closely spaced parabolic or arcuate shapes. The recessed channels are equal in length and are positioned one on top of the other between the top to the bottom of the striking face. The parabolic shaped recessed channels of the preferred embodiment are formed such that the gripping edges have a maximum width at the midpoint of the face, preferably at the center of percussion directly in front of the center of mass of the putter head. These gripping edges become progressively closer toward the heel and toe areas of the face. The progressively inward shape from both the heel and toe of the recessed channels as it grips and directs the golf ball in an inward direction. This movement serves to counter the outward dispersion direction commonly caused by miss hits away from the center of percussion. Because these recessed channels are widest at the midpoint of the striking face, the solid material, or land areas that actually strike the golf ball, between the channels is narrowest. This close vertical spacing of the parabolic channels is closely configured evenly from top to bottom on the face of a putter. This allows for a consistent and progressive gearing effect regardless where a ball is struck on the face to either side or top to bottom on the hitting area.

The degree with which the channels taper outwardly toward the heel and toe of the putter face will directly effect the degree of inward gearing at impact. To illustrate, a wider channel width in the center that tapers quickly away from the midpoint of the face, creates a wider inwardly facing V-shape. The wider the V-shape, the greater the inward gearing effect. The inward gearing effect will also vary based on the hardness of the contact surface. Using a softer contact surface will cause the gearing effect to be less. Conversely, a harder contact surface will produce a greater gearing effect.

Another variable to be considered when determining the necessary amount of gearing needed to counter miss hits is the MOI of the putter head design. Putters with higher MOI are more stable and cause a lesser degree to dispersion from miss hits and therefore require a lesser gearing effect. Conversely putter heads with a lower MOI that are less stable require more gearing to counter the dispersion from miss hits.

A preferred putter as discussed hereinabove has a series of closely spaced horizontal, parabolic, recessed channels. These parabolic channels can be configured in the form of upward or downward arches having the same or similar inward expansion as the horizontal parabolic channels.

An object of the present invention is the provision of a putter face configuration that causes a golf ball that is miss hit to go the same direction as a golf ball hit in the center of the face.

Another object is the provision of a putter face that creates a gearing effect causing a golf ball hit on either side of the center of the face to roll toward a central target line at the center of the face.

These and other objects will be apparent with reference to the following specification and accompanying drawings.

DESCRIPTION OF THE EMBODIMENTS

Figure 1:
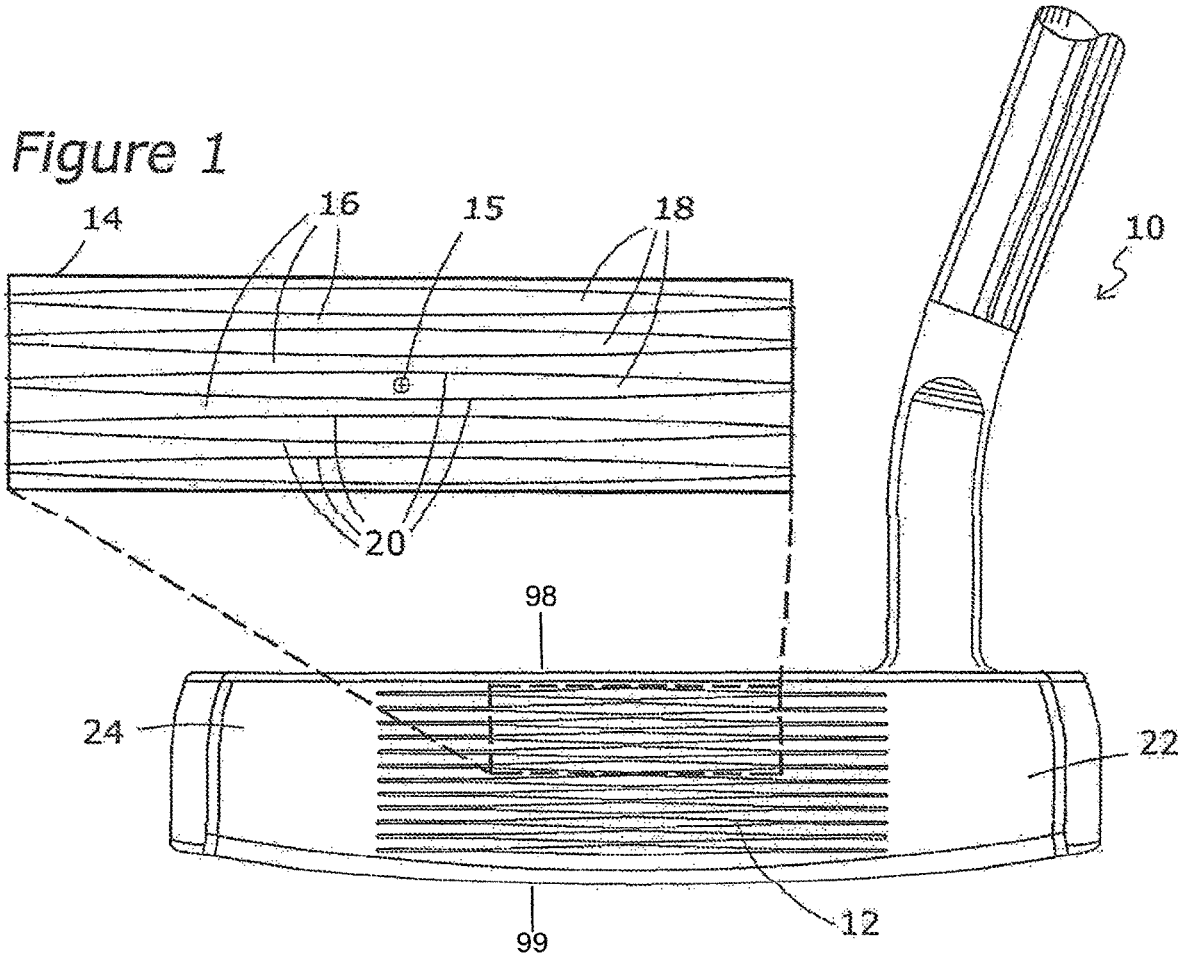
FIG. 1 is a frontal view of a putter type golf club having a face configuration in accordance with the present invention.

FIG. 1 illustrates a conventional type golf putter 10 having a bail striking face 12 that contacts the golf ball during a putting stroke. A hitting area 14 where a golf ball is normally struck during the execution of a putting stroke is shown as an exploded, enlarged detail of the face 14. This hitting area 14 is structured to progressively direct a golf ball to roll in a straight direction when hit away from the midpoint 15 of the hitting area 14 and not angle away from the target line as described in detail in this application.

A series of ball contact, land areas 16 are an integral part of the hitting area 14 of the face 12 and are the only part of the face 12 that actually contacts the golf ball during the putting stroke. Individual ball contact, land areas 16 are separated by a series of recessed channels 18 in the face 12 that do not contact the golf ball during the putting stroke. The ball contact areas land areas 16 and the recessed channels 18 extend longitudinally in a heel 22 to toe 24 direction in an alternate configuration such that a contact land area 16 is vertically stacked above an adjacent recessed channel 18 in a repeating pattern across the entire height—in a direction from a top 98 of the golf putter to the bottom 99 of the golf putter—of the hitting area 14 of the face 12. The interface of each of the land areas 16 and the recessed channels 18 forms gripping edges 20 that engage the golf ball and direct the golf ball rolling toward the intended target. The terms "land area height" and "recess height" refer to a dimension of the land areas and the recesses, respectively, in the direction from the top 98 of the golf putter to the bottom 99 of the golf putter.

In this embodiment, the land areas 16 are smaller and thinner at the proximate midpoint 15 of the face 12 than the adjacent recesses 18 and gradually increase in thickness in a gentle arc toward the heel area 22 and toe area 24 of the putter where the land areas 16 become greater in thickness than the adjacent recessed channels 18. This gradual increase of the size of the land area 16 can be seen in the detailed view of the hitting area 14 of the face 12. It follows the recessed channels 18 on either side of the midpoint 15 of the face 12 are longitudinally directional in a heel 22 to toe 24 direction and expand inwardly away from the midpoint 15 of the face 12. This forms an opening having a generally V-shape with the largest width of the opening being at the midpoint 15 of the face 12. The gripping edges 20 at the edge of the land areas 16, in turn, are closer away from the midpoint 15 of the face 12. These sideways V-shaped channels direct the golf ball toward the open direction of the V at impact and back toward the intended target line. By carefully designing the amount of increased land areas 16 and the complimentary decreased size of the recessed channels 18, the amount of turn of the golf ball toward the target line can be controlled to compensate for the miss direction caused by the ball being miss hit away from the midpoint 15 of the hitting area 14 of the face 12.

With the present invention, the opening of the V shape of a recessed channel 18 adjacent the heel area 22 of the putter 10 opens and expands toward the midpoint 15 of the hitting area 14 of the face 12 and a golf ball struck away from the midpoint 15 at this area will be redirected straight along the intended target line when making contact with the gripping edges 20. This eliminates the effect of the miss hit away from the midpoint 15 of the face 12. Likewise, the opening of the V-shape of the recessed channel 18 adjacent the toe area 24 also opens and expands toward the midpoint 15 of the face 12. A golf ball struck at this area will also be redirected toward the intended target line when making contact with the gripping edges 20 in the same way as the gripping edges 20 adjacent the heel 22.

The land areas 16 and recessed channels 18 are stacked longitudinally, one over the other, across the putter face in a heel 22 to toe 24 direction in close proximity in order to create a progressively constant, inwardly directional effect on the round golf ball regardless where a ball is struck on the putter face 12. The gripping action of the gripping edges 20 of the recessed channels 18 creates a gearing effect that is progressively greater away from the center of the face 12 that minimizes sideways dispersion caused by off-center hits. By carefully designing the shapes of the recessed channels 18, the gearing effect can be matched to the dispersion caused by miss hits of the golf ball so a miss hit golf ball will roll essentially to the same place as a center strike on midpoint 15 of the face 12. This face technology of the present invention on a golf putter virtually eliminates the effect of miss hits and directs every ball struck to travel to the same target location.

In the preferred embodiment, the land areas 16 and recessed channels 18 are symmetrically arcuate in shape whereby the land areas 16 assume a gradually decreasing radius as they are a greater distance from the midpoint of the face 12. This arcuate structure forms the inwardly facing V-shape of the recessed channels 18.

FIGS. 2 through 9 illustrate different embodiments of the land areas and recesses in accordance with the present invention. It will be appreciated these FIGS. 2-9 are an exploded section of the face of a putter in the same way as the area 14 of FIG. 1.

Figure 2:
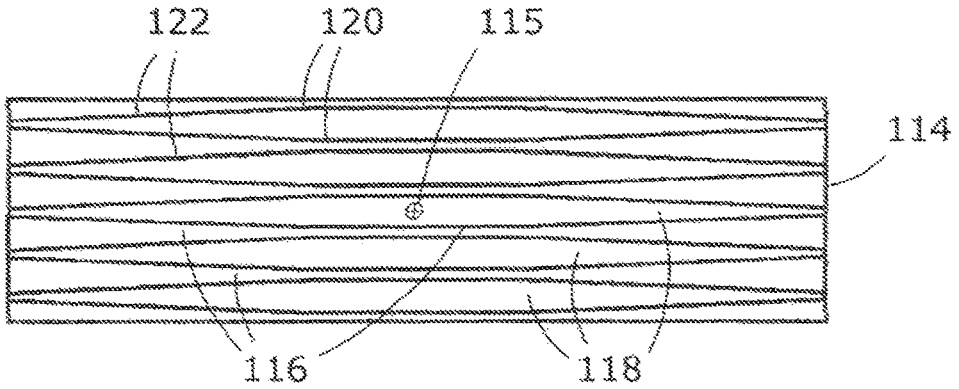
FIG. 2 is a detailed view of a second embodiment of a putter face configuration in accordance with the present invention.

FIG. 2 shows a putter face hitting area 114 having land areas 116 and recessed channels 118. At the center area around the midpoint 115 of the face 112, the land area 116 is defined by straight upper and lower edges 120 and corresponding shaped recessed channels 118 that are also straight at and either side the midpoint 115. As the land areas 116 move away from the midpoint 115, they become angled to form an elongated V-shape with corresponding V-shaped gripping edges 122.

Figure 3:
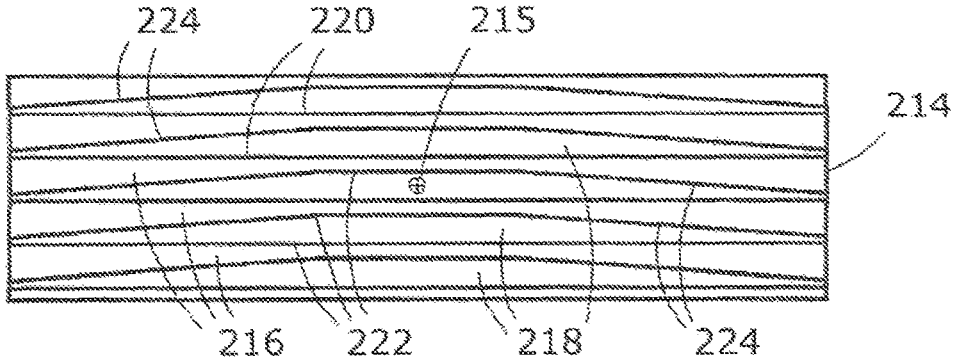
FIG. 3 is a detailed view of a third embodiment of a putter face configuration in accordance with the present invention.

FIG. 3 shows a putter face hitting area 214 having land areas 216 and recessed channels 218 having a complimentary configuration to the land areas 216. The land area 216 is defined by straight upper edge 220 across the entire striking area of the face 212 and a lower edge that is straight at and surrounding the midpoint 215 and further includes angled edges 224 at both sides of the midpoint 215 creating an elongated V-shaped configuration. Like the previous embodiments, as the land areas 216 and recessed channels 218 move away from the midpoint 215, they form an elongated V-shape with corresponding V-shaped gripping edges 222.

Figure 4:
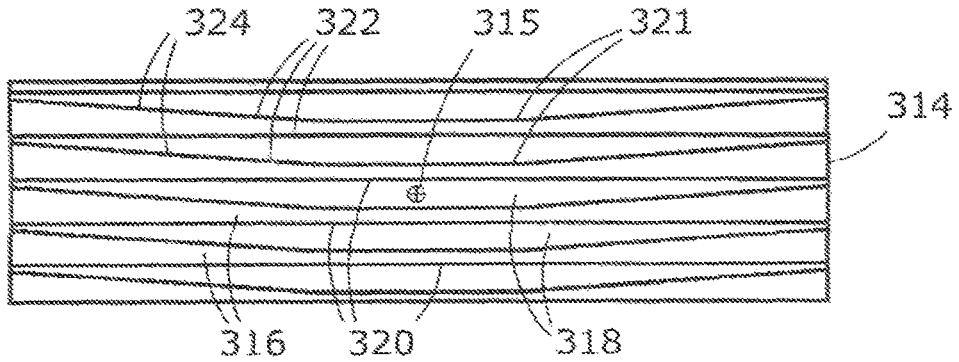
FIG. 4 is a detailed view of a fourth embodiment of a putter face configuration in accordance with the present invention.

FIG. 4 shows a putter face hitting area 314 having land areas 316 and recessed channels 318 with a complimentary configuration to the land areas 316. The land area 316 is defined by straight lower edge 320 across the entire striking area of the face 312 and an upper edge 321 that is straight at and surrounding the midpoint 315 and further includes angled edges 324 at both sides of the straight upper edge 321 at the midpoint 315 creating an elongated V-shaped configuration. Like the previous embodiments, as the land areas 316 and recessed channels 318 move away from the midpoint 315, they form an elongated V-shape with corresponding V-shaped gripping edges 322.

Figure 5:
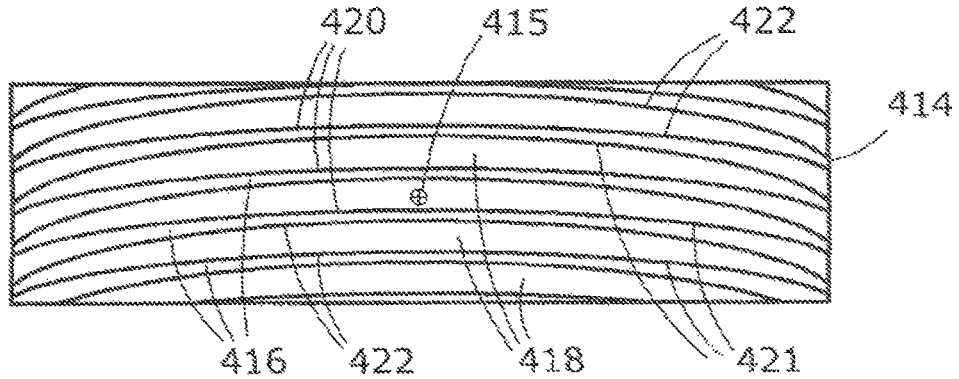
FIG. 5 is a detailed view of a fifth embodiment of a putter face configuration in accordance with the present invention.

FIG. 5 shows a putter face hitting area 414 having land areas 416 and recessed channels 418 with a complimentary configuration to the land areas 416. The land area 416 is defined by a downwardly disposed, arcuate upper edge 420 across the entire striking area of the face 412 having a first radius and a second downwardly disposed lower arcuate edge 421 that has a lesser radius that the radius of the upper edge 418. The upper edge 420 and the lower edge 421 create an elongated V-shaped configuration. Like the previous embodiments, as the land areas 416 and recessed channels 418 move away from the midpoint 415 they form an elongated, curved V-shape with curved V-shaped gripping edges 422.

Figure 6:
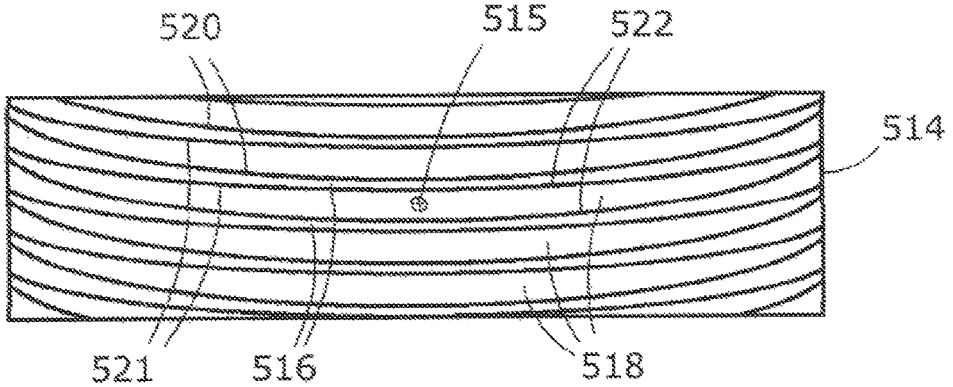
FIG. 6 is a detailed view of a sixth embodiment of a putter face configuration in accordance with the present invention.

FIG. 6 shows a putter face hitting area 514 having land areas 516 and recessed channels 518 with a complimentary configuration to the land areas 516. The land area 516 is defined by an upwardly disposed arcuate upper edge 520 across the entire striking area of the face 512 having a first radius and a second, lower upwardly disposed arcuate edge 521 that has a greater radius that the radius of the upper edge 520. The upper edge 520 and the lower edge 521 create an elongated V-shaped configuration. Like the previous embodiments, as the land areas 516 and recessed channels 518 move away from the midpoint of the face, they form an elongated, curved V-shape with curved corresponding V-shaped gripping edges 522.

Figure 7:
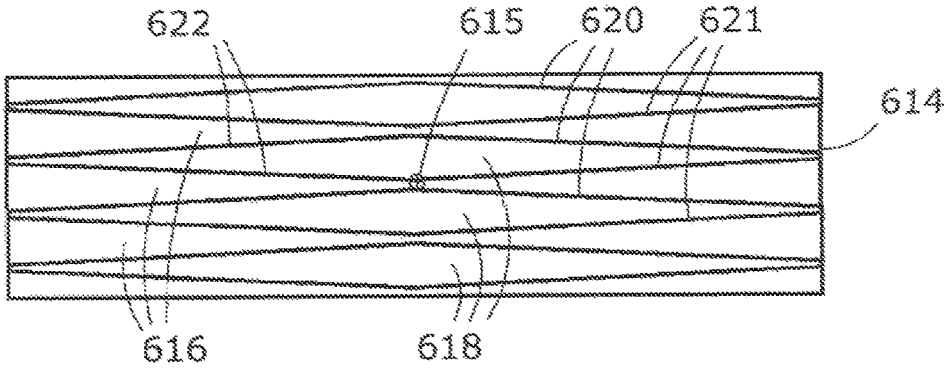
FIG. 7 is a detailed view of a seventh embodiment of a putter face configuration in accordance with the present invention.

FIG. 7 shows a putter face hitting area 614 having land areas 616 and recessed channels 618. The land area 616 is defined by an elongated upper edge 620 and a lower edge 621 that are V-shaped and merge together at the midpoint 615 of the face 612 creating a diamond shaped opening. The face 612 further includes corresponding shaped recesses 618 between the land areas 616. The interface of the land areas 616 and the recessed channels 618 form gripping edges 622 that engage the golf ball causing the ball to move toward the intended target line.

Figure 8:
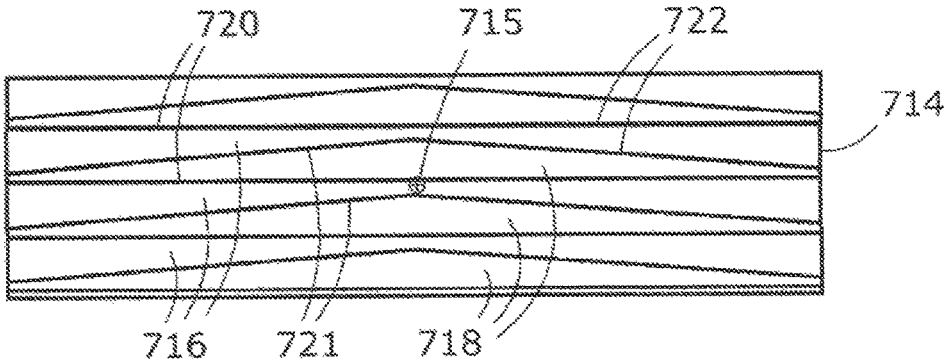
FIG. 8 is a detailed view of an eighth embodiment of a putter face configuration in accordance with the present invention.

FIG. 8 shows a putter face hitting area 714 having land areas 716 and recessed channels 718 between the land areas 716. The land area 716 is defined by an elongated upper straight edge 720 and a lower edge 721 that is angled so the upper and lower edges merge together at a midpoint 715 of the face 712 and form an upward facing angle. The interface of the land areas 716 and the recessed channels 718 form gripping edges 722 that engage the golf ball causing the ball to move toward the center.

Figure 9:
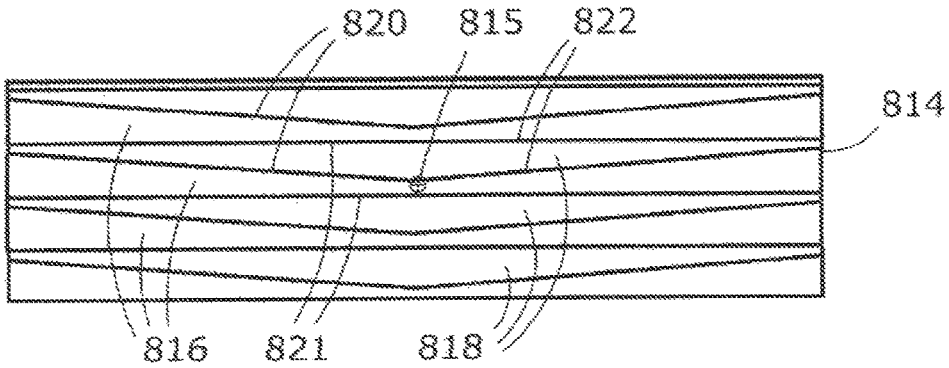
FIG. 9 is a detailed view of a ninth embodiment of a putter face configuration in accordance with the present invention.

FIG. 9 shows a putter face hitting area 814 having land areas 816 and recessed channels 818 between the land areas 816. The land area 816 is defined by an elongated upper, angled edge 820 and a lower straight edge 821 that is angled so the upper and lower edges merge together at a midpoint

815 of the face 812 forming a downwardly facing angle. The interface of the land areas 816 and the recessed channels 818 form gripping edges 822 that engage the golf ball causing the ball to move toward the center.

It will be appreciated that various modifications may be made to the putter face of the present invention in keeping within the spirit and scope of the invention as defined in the appended claims.

Having thus described the invention, it is claimed:

1. A putter type golf club head including a frontal ball striking face comprising:

a head;

a face of the head being planar and having a top and a bottom spaced from one another and a heel and a toe spaced opposite one another and between the top and the bottom;

a midpoint located between the heel and the toe;

a plurality of land areas defined on the face and configured to contact a golf ball; and a plurality of recesses extending into the face of the head to establish non-ball-contact areas adjacent to the land areas, wherein the land areas having a land area height in a top to bottom direction that is smaller than a recess height of recesses of the plurality of recesses that are located adjacent the land areas proximate the midpoint; the land area height being progressively larger away from the midpoint towards the heel and the toe;

a hitting area centrally located on the face and overlapping with the midpoint, wherein the recesses are defined as being smaller in height in a direction toward the heel and the toe of the club head away from the midpoint, the land areas and the recesses extending longitudinally in a heel to toe direction in an alternate configuration such that one land area of the plurality of land areas is stacked above one recess of the plurality of recesses located adjacent to the one land area in a repeating vertical pattern between the top and the bottom of the golf club head across the hitting area of the face.

2. The putter type golf club head of claim 1, wherein the recesses are further defined as being a V-shaped opening, the V-shaped opening being larger at the midpoint and the V-shaped opening being progressively smaller in a direction toward the heel and toward the toe of the club head.

3. The putter type golf club of claim 2, further comprising gripping edges at an interface of said land areas and said recesses for engaging and gripping the golf ball to cause the golf ball to be directed towards a point on a line perpendicular to said face and centrally aligned with the midpoint, when the golf ball is struck within the hitting area in a given putting stroke, wherein the gripping edges define a plurality of upper gripping edges and a plurality of lower gripping edges, the plurality of upper gripping edges being symmetrically arcuate and the plurality of lower gripping edges being symmetrically arcuate, wherein a distance between the gripping edges at the interface of the land areas and the recesses is widest at the midpoint and is progressively smaller in a direction toward the heel and the toe.

4. The putter type golf club of claim 3, wherein the recesses are curved.

5. The putter type golf club head of claim 4, wherein the curved recesses are arcuate.

6. The putter type golf club of claim 4, wherein the curved recesses are directed upwardly towards the top of the head.

7. The putter of claim 6, wherein the recesses comprise a diamond shape formed along multiple straight lines.

8. The putter type golf club of claim 4, wherein the curved recesses are directed downwardly towards the bottom of the head.

9. The putter type golf club of claim 3, wherein a portion of the recesses is formed along at least one straight line.

10. The putter type golf club of claim 9, wherein an upper edge of the recesses is formed along the at least one straight line.

11. The putter type of golf club of claim 9, wherein a lower edge of the recesses is formed along the at least one straight line.

12. The putter type golf club of claim 9, wherein the at least one straight line comprises two straight lines and wherein the upper and lower edges of the recesses are formed, respectively, along the two straight lines.

* * * * *